US005640230A

United States Patent [19]

Ono et al.

[11] Patent Number: 5,640,230

[45] Date of Patent: Jun. 17, 1997

[54] ELECTROSTATIC LATENT IMAGE DEVELOPING METHODS AND APPARATUSES FOR USE WITH THE METHODS

[75] Inventors: Tsuyoshi Ono, Machida; Kazunori Namiki, Miura; Hiroki Nakagami, Yokosuka, all of Japan

[73] Assignee: Victor Company of Japan, Ltd., Yokohama, Japan

[21] Appl. No.: 594,788

[22] Filed: Jan. 31, 1996

[30] Foreign Application Priority Data

Feb. 1, 1995 [JP] Japan ..... 7-035946

[51] Int. Cl.[6] ..... G03G 15/10

[52] U.S. Cl. ..... 399/151; 347/131; 347/250; 430/117; 430/125; 399/245

[58] Field of Search ..... 355/256, 246, 355/264, 296, 307, 265; 347/140, 155, 158, 250, 131; 118/659, 647, 648, 652; 430/117, 125

[56] References Cited

U.S. PATENT DOCUMENTS

| | | | |
|---|---|---|---|
| 3,892,481 | 7/1975 | Schaefer et al. | 355/264 |
| 4,021,111 | 5/1977 | Kuroishi et al. | 355/265 |
| 5,140,350 | 8/1992 | Itoh | 347/131 X |
| 5,442,426 | 8/1995 | Yamamura et al. | 355/256 |
| 5,477,313 | 12/1995 | Kuramochi et al. | 355/256 |

FOREIGN PATENT DOCUMENTS

| | | |
|---|---|---|
| 52-6090 | 2/1977 | Japan . |
| 53-16291 | 5/1978 | Japan . |
| 57-52578 | 11/1982 | Japan . |
| 57-56071 | 11/1982 | Japan . |
| 6-15065Z | 2/1994 | Japan . |

*Primary Examiner*—Arthur T. Grimley
*Assistant Examiner*—Sophia S. Chen
*Attorney, Agent, or Firm*—Michael N. Meller

[57] ABSTRACT

An electrostatic latent image developing method and an apparatus used in the latent image developing method are disclosed. In a first image developing method, a bias supply voltage provided to a developing dish is gradually increased during a developing process so as to prevent a decrease in an effective bias voltage applied to the developing dish caused by the attachment of the toner to the developing dish. Further, in a second developing method, the electrostatic latent image is formed on a photosensitive member by scanning a laser beam on a preliminarily charged photosensitive member in a lateral scanning direction, the thus formed latent image is developed by absorbing a toner in a liquid developer in a developing dish, wherein a cleaning pattern image having a large toner absorbability for absorbing the toner attached to a surface of the developing dish is provided on the photosensitive member by the laser beam before and/or after the latent image is formed on the photosensitive member.

8 Claims, 5 Drawing Sheets

ELECTROSTATIC LATENT IMAGE DEVELOPING METHODS AND APPARATUSES FOR USE WITH THE METHODS

BACKGROUND OF THE INVENTION

1. Field of the Invention

This invention relates to improvements of electrostatic latent image developing methods and apparatuses for use with the methods, in particular, relates to techniques to prevent fogging from occurring on an image in the developing process.

2. Description of the Related Arts

Generally, in electro-photographic techniques, an electrostatic latent image is recorded on a rotary drum or a surface of a photosensitive material by utilizing static electricity, and an electrostatic latent image is visualized by causing the electrostatic latent image to absorb toner of a developer in a developing process.

Next, a description is given of an example of an image forming apparatus in the prior art by a typical electrophotographic method in reference with FIGS. 1 and 2.

FIG. 1 is a schematic side view of a typical electrophotographic apparatus in the prior art; and FIG. 2 is an enlarged sectional side view of a developing tub shown in FIG. 1 in the prior art.

The image forming apparatus shown in FIGS. 1 and 2 is used, for instance, for producing a planographic sheet and a proof for a high quality print.

Referring to FIGS. 1 and 2, wherein a numeral 101 designates a rotary drum. A photosensitive member 103 fed from a roll 102 is wound around the rotary drum 101 by rotating the rotary drum 101. In the vicinity of the rotary drum 101, there are disposed a corona electrification device 104, a pre-wet device 105, a single developing tub 106 or a plurality of developing tubs 106 for color printing, a squeeger 107 for blowing away liquid developer, a fan 108 for drying the liquid developer, and a discharger 109 for discharging electric charges remaining on the photosensitive member 103 in this order.

A surface of the photosensitive member 103 wound around the rotary drum 101 is uniformly and electrically charged by the corona electrification device 104, and the electrically charged surface thereof is scanned by a laser beam "LB" modulated by image information, resulting in being exposed in accordance with the Image information.

The laser beam "LB" is outputted in a modulated state from a laser diode 110, and irradiates the surface of the photosensitive member 103 through a polygon mirror 111 and an optical system 112.

The photosensitive member 103 is generally composed of a conductive layer made of aluminum and a photoconductive layer formed thereon. When the surface of the photosensitive member 103 is scanned by the laser beam "LB", the photo-conductive layer becomes conductive. Thus, the electric charges thereon are discharged through the conductive layer connected to the ground. Therefore, the electrostatic latent image composed of electrically charged parts and non-electically charged parts is formed on the photosensitive member 103 as being scanned with the laser beam "LB" modulated by the image information, i.e., on-off control of the laser beam "LB".

When the photosensitive member 103 is exposed to the liquid developer "L" filled in the developing tub 106, the surface of the photosensitive member 103 carrying the electrostatic latent image is wetted by pre-wet liquid in the pre-wet device 105, and is developed by liquid developer "L" containing toner. The liquid developer "L" remaining on the surface thereof is blown away and substantially removed by air blow from the squeeger 107, and the remainder on the surface thereof is dried and fixed by air from the fan 108.

In a monochromatic process, the photosensitive member 103 is finally discharged from the apparatus after dried, however, in a multichromatic process such as a color proof, after the electric charges remaining on the surface are removed by the discharger 109, a plurality of processes mentioned above are successively performed for respective colors (Y: yellow, M: magenta, C: cyan and K: black) and the photosensitive member 103 are discharged from the apparatus.

In FIG. 1, a numeral 113 designates a toner pump, 114 a controller, and 115 an electric circuit device.

As shown in FIG. 1, the developing tub 106 is provided with a developing dish 116 capable of facing the surface of the rotary drum 101 for supplying the liquid developer "L" to the surface of the photosensitive member 103.

Specifically, the developing dish 116 has a surface **116*a* confronting the surface of the rotary drum 101. The surface 116*a* thereof has approximately the same radius as that of the rotary drum 101. In other words, a predetermined gap "G", for instance, with its length of 0.35 to 0.4 mm, is formed between the surface 116*a* of the developing dish 116 and the surface of the rotary drum 101 around which the photosensitive member 103** is provided.

The liquid developer "L" contains toner carrying electrostatic charges each having an reverse polarity to the electrically charged portion of the photosensitive member 103, coloring matter (dye/pigment) and resin. Upon developing, the liquid developer "L" is supplied to the gap "G" through a supplying slit **116*c* formed on the surface 116*a* of the developing dish 116. Therefore, while the surface of the photosensitive member 103 is passing along the gap "G" filled with the liquid developer "L", the toner is attracted or absorbed on the electrically charged portions of the photosensitive member 103**, thus the electrostatic latent image is visualized by being developed.

In the developing process mentioned above, the electric charges are removed by irradiating the laser beam "LB" on the electrically charged portion of the photosensitive member 103, resulting in forming a portion where the toner is not to be attached. This portion is referred to as a non-image forming section. On the other hand, a portion where the electric charges remain by causing the laser beam "LB" to be off is referred to as an image forming section in the present invention.

As the situation now stands, however, the electric charges are not always removed completely from the non-image forming section. The electric charges remain slightly on the non-image forming section in correspondence with the conditions of the laser power and the other processes, resulting in producing a residual electric charge potential thereon. This is apt to produce blurring phenomenon (referred to as blurring) on the picture resulting from the deposition of the toner on the non-image section.

In well known methods to reduce the adverse effect of the residual electric charge, there is a method where a bias voltage (a developing bias voltage) is applied from a bias power supply 117 to the developing dish 116 from which the liquid developer "L" overflows to develop the photosensitive member 103. The bias voltage has an reverse polarity to the toner charge and a larger voltage than the residual electric charge potential of the non-image forming section so as to cancel the adverse effect of the residual electric charge potential. Whereby, the deposition of the toner on the non-image section is prevented because the toner is attracted onto the developing dish 116.

Further, when the toner adhering to the developing dish 116 resulting from an interruption of the circulation of the liquid developer "L" has been dried, it is difficult to remove the toner from the developing dish 116. Accordingly, the liquid developer "L" is always circulated after the system power supply (not shown) is turned on.

However, applying the bias voltage to the developing dish 116 provides a condition where the toner is easily attracted to the developing dish 116 and adheres thereto.

For instance, when the non-image section is successively supplied to the developing dish 116, the toner gradually adheres on the developing dish 116 correspondingly with the a length (in the moving direction of the photosensitive member) of the non-image section because the non-image section does not attract the toner. The toner adhered to the developing dish 116 substantially cancels the biasing effect of the bias voltage. This poses a problem of the blurring on the image developed. As a result, when the pattern of the non-image section (corresponding to a white paper portion) successively appears, the toner is attracted to a particular portion corresponding to the non-image section, so that the bias effect is reduced correspondingly therewith. This causes blurring on the non-image section where image or the like is not to be formed, in particular, in the latter half of the developing process.

In order to eliminate this blurring, there have been proposed various kind countermeasures.

For instance, in Japanese Patent Publication No. 53-16291/1978 (Japanese Patent Laid-open Publication 47-18542/1972), there is disclosed a method that a DC bias voltage is applied to the developing dish along with an alternating voltage to prevent contamination of the electrode.

Further, in Japanese patent publication No. 57-52578/1982 (Japanese Patent Laid-open Publication 51-74636/1976), there is disclosed a method that a positive bias voltage is applied to the developing dish along with an alternating voltage for cleaning upon developing, and a negative bias voltage is applied thereto along with the alternating voltage upon off-developing.

Further, in Japanese patent publication No. 57 56071/1982 (Japanese Patent Laid-open Publication 50-159741/1975), there is disclosed that an alternating voltage is applied to the developing electrode on the basis of a surface potential of the portion where the latent image is formed.

Further, in Japanese patent publication No. 52-6090/1977 (Japanese Patent Laid-open Publication 48-64938/1973), there is disclosed that a layer for preventing the toner from attaching is provided on the surface of the developing electrode.

However, it was not always possible to obtain the satisfactory toner deposition preventing effect and toner removing effect which were intended in these methods mentioned above. In the prior arts disclosed in Japanese patent publications No. 53-16291/1978 (Japanese Patent Laid-open Publication 47-18542/1972), No. 57-56071/1982 (Japanese Patent Laid-open Publication 50-159741/1975) and No. 57-52578/1982 (Japanese Patent Laid-open Publication 51-74636/1976), there were problems that they required rather complicated circuit constructions to realize the apparatuses for the purposes.

In the apparatuses for use with color printing, in particular, each of developing processes of Y, M, C, and K is performed by using an exclusive developing dish corresponding to a specified color. Thus, there is desired the apparatus having an effective blurring prevention and a simple circuit construction as much as possible.

SUMMARY OF THE INVENTION

Accordingly, a general object of the present invention is to provide electrostatic latent image developing methods and apparatuses for use with the methods in which the disadvantages discussed in the foregoing paragraphs have been eliminated.

A more specific object of the present invention is to provide a developing method and an apparatus without producing blurring on the picture by maintaining an effective developing bias voltage constant even when the toner is deposited on the surface of the developing dish.

A more specific object of the present invention is to provide an electrostatic latent image developing method for performing a developing process in which a liquid developer is circulated to flow between a photosensitive member formed with an electrostatic latent image thereon and a developing dish confronting the photosensitive member, and a bias voltage is applied to the developing dish, wherein the bias voltage is gradually increased as the developing process is being proceeded.

Another and more specific object of the present invention is to provide an electrostatic latent image developing apparatus for performing a developing process in which a liquid developer is circulated to flow between a photosensitive member formed with an electrostatic latent image thereon and a developing dish confronting the photosensitive member, and a bias voltage is applied to the developing dish, wherein the electrostatic latent image developing apparatus further comprises bias voltage supplying means for gradually increasing the bias voltage as the developing process is being proceeded.

Another and more specific object of the present invention is to provide an image forming method for forming an electrostatic latent image on a photosensitive member by scanning a laser beam on the photosensitive member in a lateral scanning direction with respect to a transferring direction of the photosensitive member to form the electrostatic latent image thereon and by causing the electrostatic latent image to absorb a toner of a liquid developer in a developing dish, wherein a cleaning pattern image having a large toner absorbability for absorbing the toner attached to a surface of the developing dish, is provided on the photosensitive member by scanning the laser beam before the electrostatic latent image is formed on the photosensitive member so that the cleaning pattern image is positioned at a preceding position with respect to the electrostatic latent image in the transferring direction of the photosensitive member.

Another and more specific object of the present invention is to provide an image forming method for forming an electrostatic latent image on a photosensitive member by scanning a laser beam on the photosensitive member in a lateral scanning direction with respect to a transferring direction of the photosensitive member to form the electrostatic latent image thereon and by causing the electrostatic latent image to absorb a toner of a liquid developer in a developing dish, wherein a cleaning pattern image having a large toner absorbability for absorbing the toner attached to a surface of the developing dish, is provided on the photosensitive member by scanning the laser beam after the electrostatic latent Image is formed on the photosensitive member so that the cleaning pattern image is positioned succeeding to the electrostatic latent image with respect to the transferring direction of the photosensitive member.

Another and more specific object of the present invention is to provide an image forming apparatus for forming an electrostatic latent image on a photosensitive member, the photosensitive member being preliminarily charged electrically and the electrostatic latent image being formed thereon by scanning a laser beam on the photosensitive member in a lateral scanning direction perpendicular to a transferring direction of the photosensitive member, thereby the photosensitive member being exposed to the laser beam to form the electrostatic latent image thereon and the electrostatic latent image thus formed being developed by causing the electrostatic latent image thus formed to absorb a toner of a liquid developer in a developing dish, the image forming apparatus comprising: memory means for storing data of a cleaning pattern image having a large toner absorbability for absorbing the toner attached to a surface of the developing dish; and control means for controlling the data of the cleaning pattern image so as to be formed on the photosensitive member before the electrostatic latent image being formed on the photosensitive member so that the cleaning pattern image is positioned preceding to a front side of the electrostatic latent image with respect to the transferring direction of the photosensitive member.

Another and more specific object of the present invention is to provide an image forming apparatus for forming an electrostatic latent image on a photosensitive member, the photosensitive member being preliminarily charged electrically and the electrostatic latent image being formed thereon by scanning a laser beam on the photosensitive member in a lateral scanning direction perpendicular to a transferring direction of the photosensitive member, thereby the photosensitive member being exposed to the laser beam to form the electrostatic latent image thereon and the electrostatic latent image thus formed being developed by causing the electrostatic latent image thus formed to absorb a toner of a liquid developer in a developing dish, the image forming apparatus comprising: memory means for storing data of a cleaning pattern image having a large toner absorbability for absorbing the toner attached to a surface of the developing dish ; and control means for controlling the data of the cleaning pattern image so as to be formed on the photosensitive member after the electrostatic latent image being formed on the photosensitive member so that the cleaning pattern image is positioned succeeding to the electrostatic latent image with respect to the transferring direction of the photosensitive member.

Other objects and further features of the present invention will be apparent from the following detailed description.

DETAILED DESCRIPTION OF THE PREFERRED EMBODIMENTS

[A first embodiment]

Figure 3:
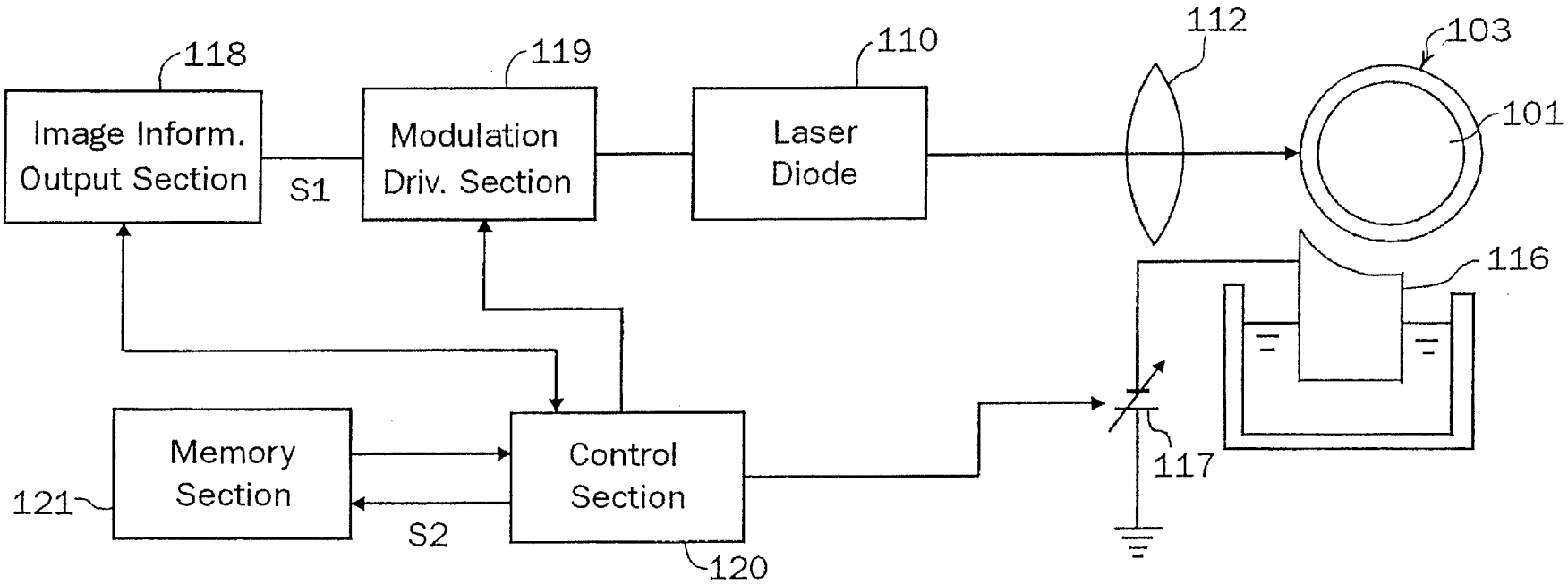
FIG. 3 is a block diagram showing main parts of an image forming apparatus for use with the latent image developing apparatus of a first embodiment in the present invention.
Figure 4:
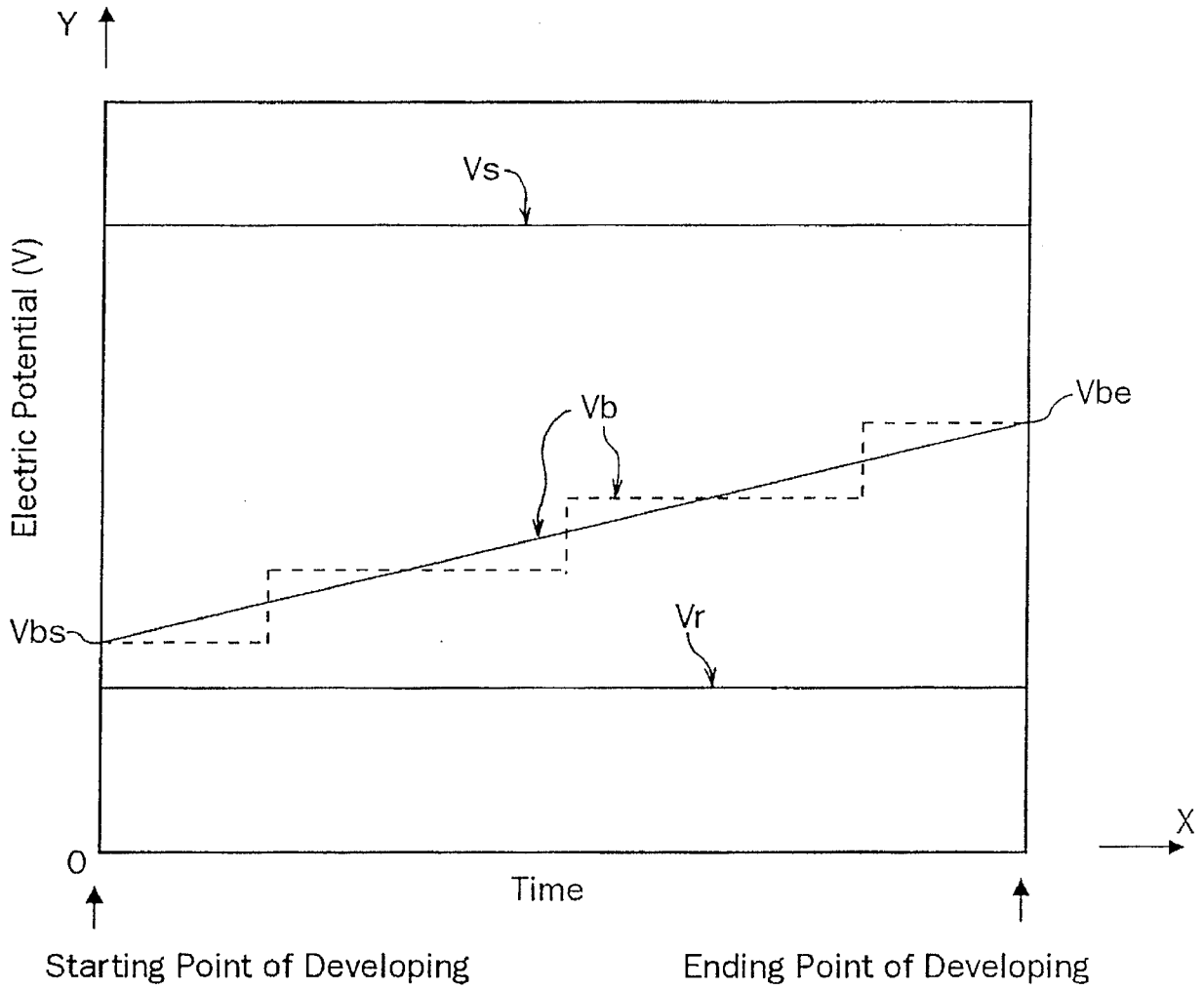
FIG. 4 is a graph showing a control of a developing bias voltage in the present invention.

A description is given of a first embodiment of a latent image developing method and an apparatus of the present invention in reference with FIGS. 3 and 4.

FIG. 3 is a block diagram showing main parts of an image forming apparatus for use with the latent image developing apparatus of a first embodiment in the present invention; and FIG. 4 is a graph showing a control of a developing bias voltage in the present invention.

Figure 1:
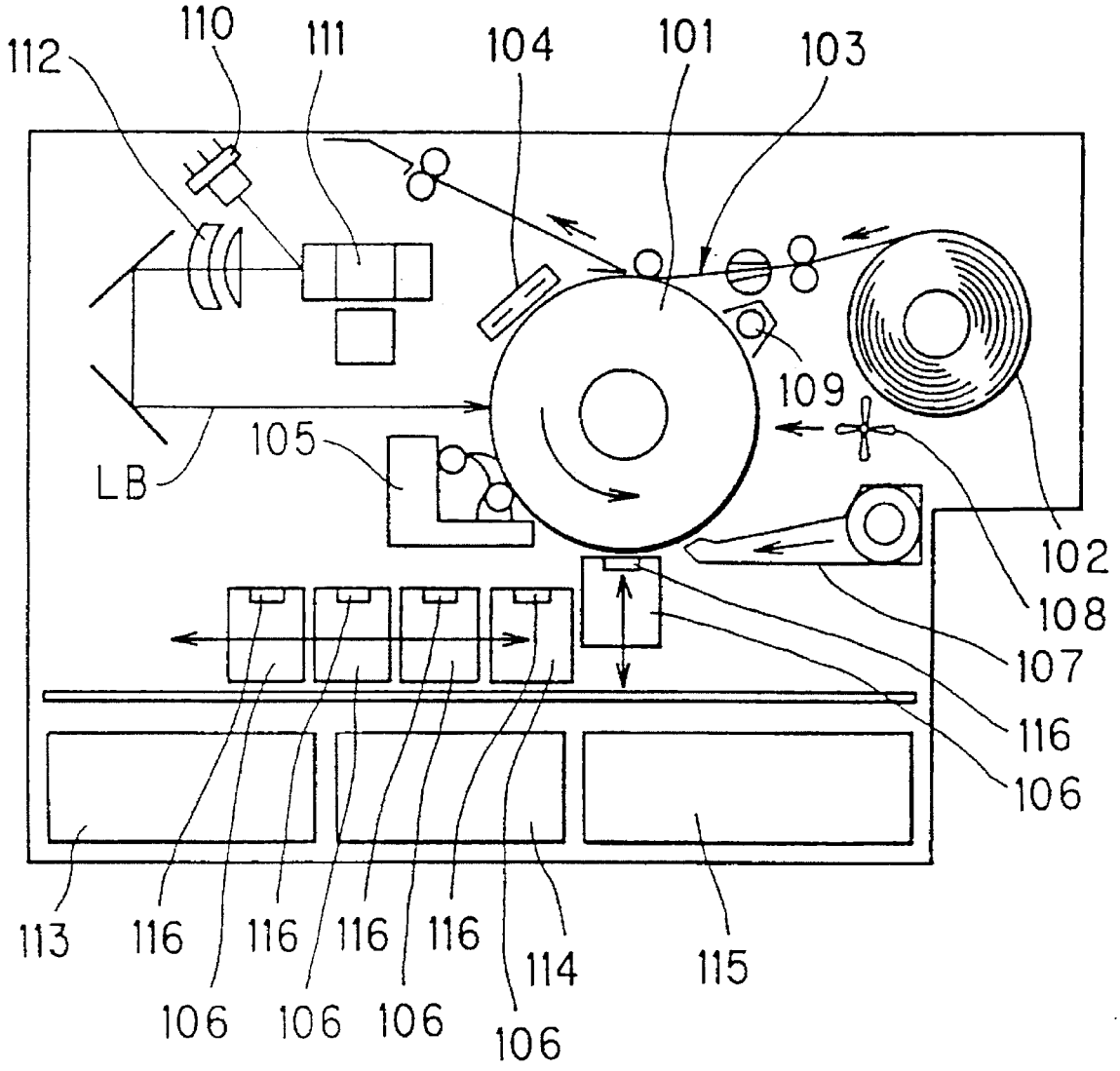
Fig.1 Prior Art
FIG. 1 is a schematic side view of a general electrophotographic apparatus in the prior art.
Figure 2:
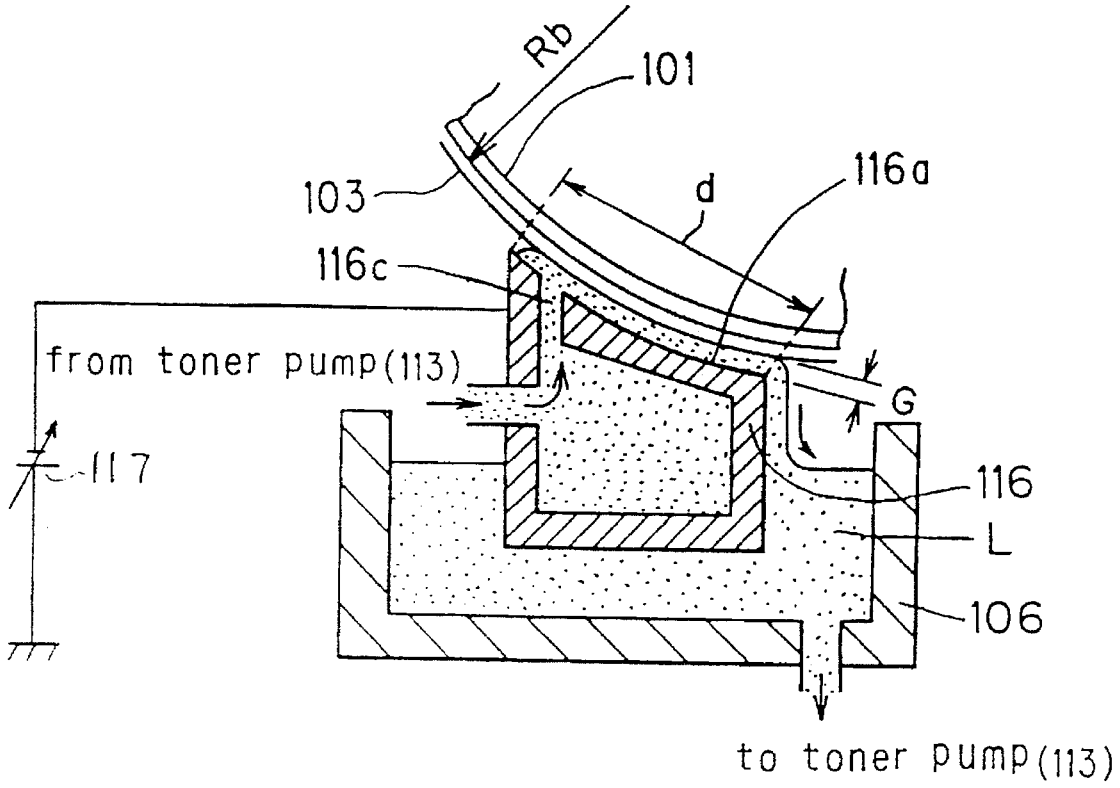
Fig.2 Prior Art
FIG. 2 is an enlarged sectional side view of a developing tub shown in FIG. 1 in the prior art.

In the image developing apparatus of the present invention, it has substantially the same construction as that of the apparatus shown in FIGS. 1 and 2 except for an alternation of a computer program stored in the apparatus.

Referring to FIG. 3, there are shown main parts of the image forming apparatus for use with the latent image developing apparatus in a form of a block diagram. The main parts perform processes from an exposure process of the photosensitive member 103 to a developing process thereof.

Specifically, a numeral 118 denotes an image information output section, from which a desired image signal "S1" is outputted to a modulation driving section 119. This modulation driving section 119 drives the laser diode 110 on the basis of an on-off operation corresponding to the image signal "S1", thereby the laser beam "LB" modulated corresponding to the image signal "S1" is outputted from the laser diode 110. The laser beam "LB" modulated is focused by the optical system 112 and forms an electrostatic latent image on the surface of the photosensitive member 103 wound around the rotary drum 101. The photosensitive member 103 formed with the electrostatic latent image is exposed to the liquid developer "L" in the developing dish 116, and is developed thereby.

From the developing dish 116 provided in the developing tub 106, the liquid developer "L" always overflows to circulate through the developing tub 106 as shown in FIG. 2. This developing dish 116 is given a developing bias voltage (bias voltage) from the bias power supply 117. This bias voltage is made larger than the residual electric charge potential of the non-image forming section so as to attract the toner to the developing dish 116. Thus, the production of the blurring on the image is prevented. The value of the bias voltage is controlled by a control section 120 as mentioned hereafter.

The features of the first embodiment of the latent image developing device and method are that the bias voltage is substantially maintained constant by increasing the value of the bias supply voltage gradually while the photosensitive member 103 is exposed to the liquid developer "L", to compensate a reduction of the effective bias voltage resulting from adherence of the toner on the developing dish 116.

The transition pattern of the bias voltage with respect to a lapse of time may be preliminarily stored in the control section 120 composed of a microcomputer in a form of a program. And upon turning on the system power supply of the apparatus, the program composes actual data of the pattern and transfers them to a RAM of a memory section 121 for performing the intended bias control.

Further, as another method, the transition pattern of the bias voltage may be directly stored in a ROM (Read Only Memory) in the memory section, and the bias voltage may be controlled by the control section 120 based on data S2 of the transition pattern thereof read out from the ROM by the control section 120 as required.

There is shown an example of the transition pattern of the bias voltage with respect to a lapse of time in FIG. 4, wherein the X coordinate denotes the lapse of time from the start of developing process to the end thereof, and the Y coordinate denotes an electric potential (V). In FIG. 4, a reference character "Vs" denotes an electric charge potential of the image forming section of the photosensitive member 103, "Vb" a bias voltage linearly changed or changed in a step condition, "Vbs" an initial bias voltage at a starting point of developing, "Vbe" a final bias voltage at an ending point of developing, "Vr" the residual electric charge potential of the non-image forming section.

As shown in FIG. 4, upon starting the developing process, the initial bias voltage "Vbs" at the starting point is established slightly higher than that of the residual electric charge potential "Vr" of the non-image section (for instance, a few volts higher than the residual electric charge potential "Vr").

The bias voltage "Vb" is successively increased as the the photosensitive member 103 is transferred through the liquid developer "L" in the developing dish 116. When the developing process is finished, the bias voltage "Vb" comes to the final bias voltage "Vbe" (for instance, a few volts higher than the initial bias voltage "Vbs").

The bias voltage "Vb" may be gradually increased stepwise shown with a dotted line.

It is noted that the increment of the bias voltage "Vb" causes the decrease of the effective electric charge potential of the image forming section, so that the developing density of the liquid developer "L" is reduced. Thus, the bias voltage "Vb" should be established to be low enough that the reduction of the developing density is within an allowable range in practical use.

The increase rate of the bias voltage "Vb" and the timing of stepping increase thereof may be preliminarily determined with respect to the lapse of time.

As an alternative, they may be determined by the control section 120 in response to a signal generated by an encoder (not shown) for detecting a rotation angle of the rotary drum 101.

In this embodiment, the description is given on condition that the transition pattern of the bias voltage "Vb" including the initial value "Vbs" and the final value "Vbs" is preliminarily to be obtained from experimental results which depend on the system characteristics of the image forming apparatus, however, this invention is not limited within this method. Specifically, in the image information output section 118, a ratio of an area of the image section to that of the non-image section may be calculated for every image to be outputted. The control section 120 controls the abovementioned parameters based on the results of the calculation.

For instance, when the ratio of the area of the image section to that of the non-image section is larger compared with those of the average value of the ratio, the final value "Vbe" is established to a lower value. Thus, it is possible to control the bias voltage corresponding to the characteristic of the image to be outputted.

In this embodiment, the description is given of a case where the photosensitive member 103 is wound around the surface of the rotary drum 101 by one revolution, however, this method is applicable to a case where the photosensitive member 103 is supported in a flat state.

As mentioned in the foregoing, according to the first embodiment of the electrostatic latent image developing method and the apparatus used in the method in the present invention, the bias voltage is substantially maintained constant by increasing the value of the bias supply voltage gradually while the photosensitive member 103 is exposed to the liquid developer "L" in order to compensate a decrease of the effective bias developing voltage resulting from adherence of the toner on the developing dish 116. Thus, the blurring is prevented from generating on the image.

This contributes to forming a high quality image, in particular, upon performing the multi-color developing process on the same photosensitive member 103.

[A second embodiment]

Next, a description is given of a second embodiment of the electrostatic latent image developing method and the apparatus used in the method in the present invention.

The constructions of the image forming apparatus and the developing device in the second embodiment are substantially the same as those of the first embodiment. Thus, the detailed description thereof is omitted here for simplicity.

A feature of this second embodiment is that there is employed a cleaning pattern image (referred to as cleaning pattern) for absorbing the excess toner adhered on the surface of the developing dish 116. With respect to a feeding direction of the photosensitive member 103, this cleaning pattern is provided on the photosensitive member 103 preceding the image to be developed or succeeding it or both preceding and succeeding area with respect to the image to be developed.

The shape of the cleaning pattern may be preliminarily installed in a form of program In the control section 120 equipped with a microcomputer. Upon turning on the system power supply, predetermined data of the cleaning pattern may be inputted in the RAM of the memory section 121. Further, the predetermined data thereof may be directly memorized in the ROM of the memory section 121. The data of the cleaning pattern is read out by the control section 120 as required, and is transferred to the image information output section 118.

Figure 5:
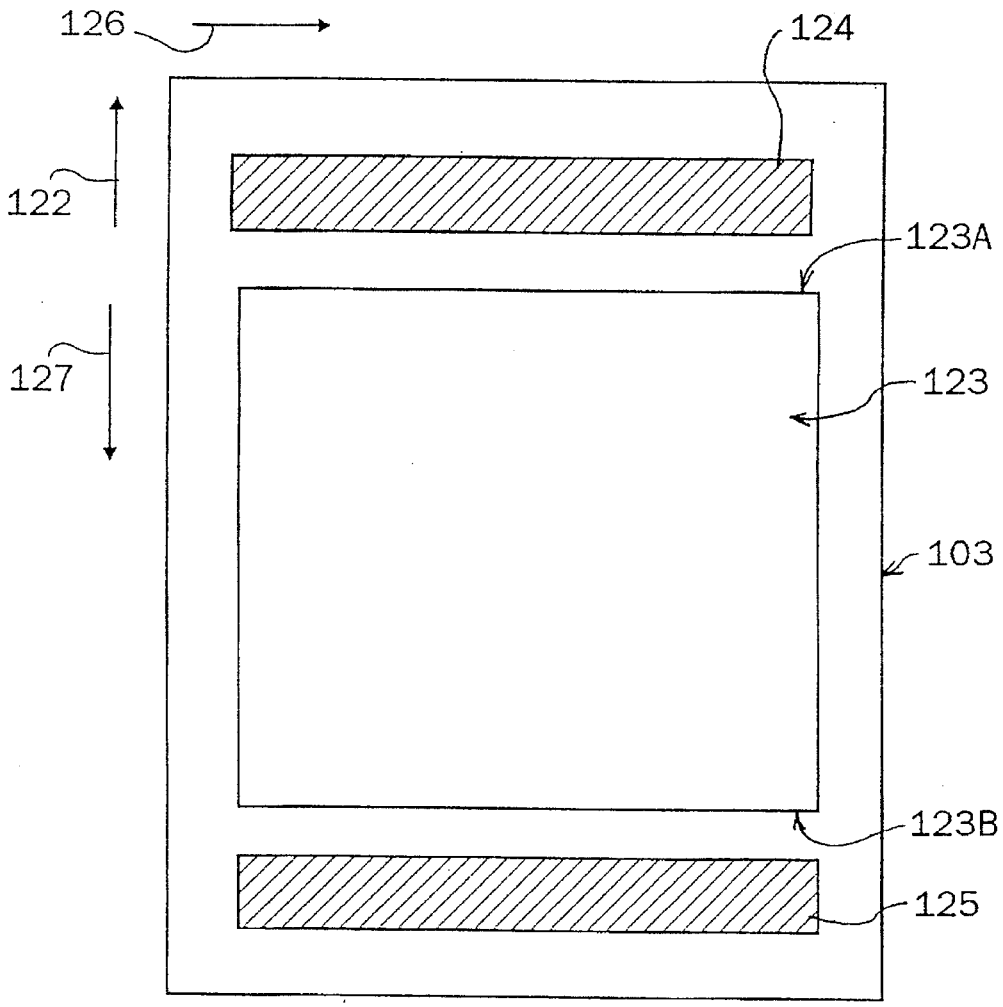
FIG. 5 is a plan view showing a relation between an image to be formed and a cleaning pattern.

The cleaning pattern of the present invention is shown in FIG. 5.

FIG. 5 is a plan view showing a relation between an image to be formed and a cleaning pattern.

Referring to FIG. 5, the photosensitive member 103 having a rectangular shape is transferred in a direction shown with an arrow 122. In the center of the photosensitive member 103 with respect to a direction of the length thereof, a desired image area is provided to form an image 123 corresponding to the image information.

For instance, a preceding cleaning pattern 124 and a succeeding cleaning pattern 125 each having a long rectangular shape of a solid color, are provided so that the image 123 is Interposed therebetween on the photosensitive member 103. This provision of the cleaning patterns 124 and 125 with respect to the image is controlled by the control section 120 on the basis of data stored in the memory section 121. The preceding cleaning pattern 124 comes into contact with the liquid developer "L" before the image 123 does and the succeeding cleaning pattern 125 comes into contact therewith after the image 123 has been developed by the liquid developer "L" when the photosensitive member 103 is transferred in the direction shown with the arrow 122.

Next, a description is given of operations of the second embodiment of the present invention.

When the developing process is started, the developing dish 116 in the developing tub 106 moves upward so as to closely confront the photosensitive member 103 wound around the rotary drum 101. Thus, the developing dish 116 is settled in a developing position. On the surface of the developing dish 116, the liquid developer "L" is supplied so as to circulate through the developing tub 106. A bias voltage is also applied to the developing dish 116 from the bias power supply 117.

As the photosensitive member 103 wound around the rotary drum 101 move toward and along the developing dish 116, the electrostatic latent image of the preceding cleaning pattern 124 is formed on the photosensitive member 103 before a start line 123A of the image 123 is formed.

The electrostatic latent image of the preceding cleaning pattern 124 is developed by absorbing the toner during being exposed to the liquid developer "L" in the developing dish 116. At that time, not only the toner in the liquid developer "L" but also the toner adhered on the surface of the developing dish 116 is absorbed by the preceding cleaning pattern 124. Thus, after the preceding cleaning pattern 124 has passed through the liquid developer "L" in the developing dish 116, there remains almost no toner on the surface of the developing dish 116. Thus, the surface thereof maintains clean without the toner.

After the developing dish 116 has been cleaned, the image area on which the desired image is formed, is successively developed by being exposed to the liquid developer "L" in the developing dish 116 cleaned without the toner.

In the image area, the toner in the liquid developer "L" newly supplied from the pump 113 through a supplying slit 116*c* are moderately absorbed by the image area corresponding to the desired image pattern without a large reduction of the bias voltage. As a result, excessive toner is prevented from depositing on the image, and it is possible to obtain a high quality image without the blurring.

On the other hand, when the desired image contains white portions, an unconsumed toner is accumulated on the developing dish 116 corresponding with the white portion. This causes the effective bias voltage to be decreased, so that the blurring is apt to occur on the subsequently developed desired image.

However, in the present invention, there is formed the succeeding cleaning pattern 125 having the same shape as that of the preceding cleaning pattern 124 subsequent to an end line 123B of the image 123 so as to be developed instead of the white. Thus, not only the toner in the liquid developer "L" in the developing dish 116 but also the toner attached on the surface of the developing dish 116 is consumed by the succeeding cleaning pattern 125. Thus, the developing dish 116 is left clean without holding an excessive toner. This provides a clean developing dish 116 without the excessive toner for the subsequent developing process and prevents the excessive toner from attaching to the image, resulting in a high quality Image without the blurring.

In particular, when the succeeding cleaning pattern 125 is developed, it is preferable to cut the bias voltage applied to the developing dish 116 to enhance the toner absorbability of the succeeding cleaning pattern 125 because the effective electric charge potential of the succeeding cleaning pattern 125 is relatively increased resulting from the cut-off of the bias voltage.

As another method to enhance the toner absorbability of such cleaning patterns, it is effective to increase the electric charge potential of such cleaning patterns formed on the photosensitive member 103.

Generally, it takes a time in some degree until the bias effect is stabilized. Thus, upon developing the preceding cleaning pattern 124, it is preferable to apply the bias voltage to the developing dish 116 because the image 123 has to be developed subsequently. Thereby, a high quality image is obtained.

After the development of the Image is finished, the developing dish 116 moves downward to a waiting position.

In the waiting position, the liquid developer "L" is circulated to prevent the toner from drying and adhering to the developing dish 116.

For developing a plurality of colors for producing a color image, after the surface of the photosensitive member 103 is dried and quenched (optical discharge), the same developing process as mentioned above is performed again for every color.

The widths of the preceding and succeeding cleaning patterns 124, 125 in a lateral scanning direction shown with an arrow 126 are determined to have the same width as that of the image 123 or more so as to cover a whole stretch of the image 123. In this case, it is possible to clean the whole developing dish 116 by determining the widths of the preceding and succeeding cleaning patterns 124, 125 to be the width of the developing dish 116.

In this embodiment, the preceding and succeeding cleaning patterns 124, 125 are made to be a fully filling (solid) black color (pattern), however, this invention is not limited within the embodiment. Any cleaning pattern is applicable as long as it has a high absorbing characteristic per a unit area of the photosensitive member 103 to adequately absorb the toner adhered to the surface of the developing dish 116. Such cleaning pattern is preferably used in the case where the following conditions are satisfied with respect to any position in the lateral scanning direction shown with the arrow 126.

(1) A cumulated length of actual toner attracting area of the cleaning pattern in a vertical scanning direction of the photosensitive member 103 shown with an arrow 127 is not less than a half of a developing length "d" of the developing dish 116.

(2) A rate of the above cumulated length with respect to the length of the cleaning pattern in the vertical scanning direction shown with the arrow 127 is not less than 50%.

Figure 6A:
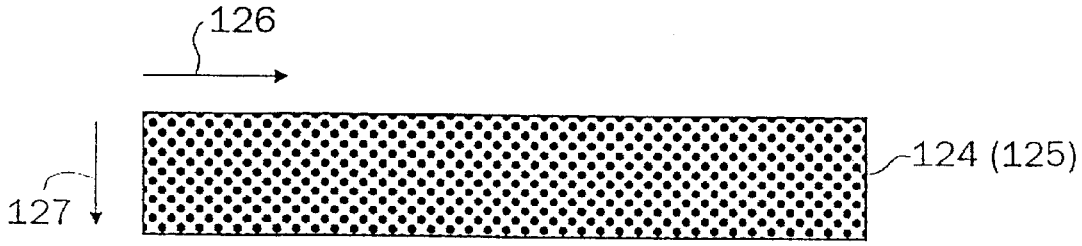
FIG. 6(A) is a plan view showing an example of the cleaning pattern in the present invention.
Figure 6B:
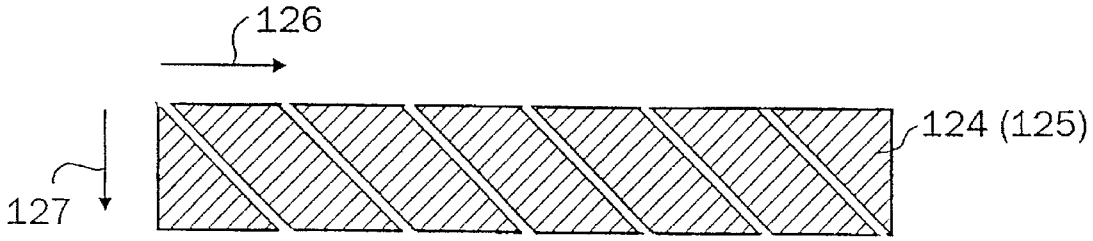
FIG. 6(B) is a plan view showing another example of the cleaning pattern in the present invention.

As examples of the cleaning patterns satisfying the above conditions, there are shown a cleaning pattern 124 (125) having a plurality of dots therein as shown in FIG. 6 (A) and another cleaning pattern 124 (125) having a plurality of close parallelograms disposed in the lateral scanning direction shown with the arrow 126 as shown in FIG. 6(B).

FIG. 6(A) is a plan view showing an example of the cleaning pattern in the present invention; and FIG. 6(B) is a plan view showing another example of the cleaning pattern in the present invention.

However, it is preferable to use the cleaning pattern of the solid black color in the view of the effective toner absorbing characteristic, which contributes to compactness of the apparatus because it requires no large sized photosensitive member to form the cleaning pattern, thus, requires no large rotary drum 101.

As another merit of the cleaning pattern of the solid black color, it can be used instead of a color patch for checking the recorded color density. When checking a plurality of colors, plural cleaning patterns are provided separately so as not to overlap to each other.

In either case, the cleaning pattern is easily producible based on the cleaning pattern data stored in the apparatus. For instance, these pattern data are stored in the memory section 121 and are transferred to the image information output section 118 to form the image interposed between the preceding and succeeding cleaning patterns 124, 125 upon performing the developing process.

Further, it is possible to Include the cleaning pattern data into the image data themselves without adding the pattern data additionally.

Further, upon stopping the circulation of the liquid developer "L" by cutting off the power supply, these cleaning patterns can be used to prevent the toner from adhering on the developing dish 116 when dried. In this case, following operations may be selectively employed to enhance the toner absorbing efficiency.

(1) The bias voltage may be cut-off upon developing the cleaning pattern, and the electric charge potential of the cleaning pattern may be increased to enhance the effective electric charge potential thereof so that the developing dish is effectively cleaned in the same manner as mentioned in the foregoing.

(2) There may be formed a cleaning pattern having a larger length in the vertical scanning direction of the photosensitive member 103 than that of the ordinary cleaning patterns 124, 125 to completely absorb the toner attached on the surface of the developing dish 116.

(3) The circulation of the liquid developer "L" may be stopped during the development of the cleaning pattern. In this case, when the cleaning pattern has an adequate large length in the vertical scanning direction of the photosensitive member 103, it is possible to effectively absorb both the toner attached on the developing dish 116 and the toner between the photosensitive member 103 and the developing dish 116 by stopping the circulation of the liquid developer because the liquid developer "L" is not newly supplied.

(4) Data for the cleaning pattern may only be outputted and developed without outputting the desired image data. Thereby, the consumption of the photosensitive member 103 and the developing time can be saved.

(5) In the final process of the plural developing processes of the color image, it is possible to use commonly to respective colors, the same portion of the photosensitive member 103 for producing the cleaning pattern.

The above description is given of the embodiment where the preceding and succeeding cleaning patterns 124, 125 are respectively provided on the preceding and succeeding position of the image 123, however, it Is possible to provide either the preceding cleaning pattern 124 or the succeeding cleaning pattern 125 only at one position on the photosensitive member 103 because in a standby state for the subsequent developing process the bias voltage is not given to the developing dish 106, thus, the toner hardly attaches to the developing dish 116, even when the liquid developer "L" is circulated during the standby state. Thereby, the unnecessary consumption of the photosensitive member 103 can be prevented.

Further, in the above description, the photosensitive member 103 is transferred in the direction 122 being wound around the rotary drum 101, however, it is possible to transfer it being supported by a flat supporter.

As mentioned in the foregoing, according to the second embodiment of the image forming method and the apparatus in the present invention, it is possible to absorb the toner attached on the surface of the developing dish by the cleaning pattern provided at one of the preceding and succeeding position of the image or at the both positions thereof on the photosensitive member. Thus, the developing dish can always maintain a clean state. This contributes to obtaining the high quality image.

What is claimed is:

1. An electrostatic latent image developing method for performing a developing process in which a liquid developer is circulated to flow between a photosensitive member formed with an electrostatic latent image thereon and a developing dish confronting the photosensitive member, and a bias voltage is applied to the developing dish, wherein the bias voltage is gradually increased as the developing process proceeds.

2. An electrostatic latent image developing method as claimed in claim 1, wherein the bias voltage is continuously increased.

3. An electrostatic latent image developing method as claimed in claim 1, wherein the bias voltage is increased stepwise.

4. An electrostatic latent image developing apparatus for performing a developing process in which a liquid developer is circulated to flow between a photosensitive member formed with an electrostatic latent image thereon and a developing dish confronting the photosensitive member, and a bias voltage is applied to the developing dish, wherein the electrostatic latent image developing apparatus further comprises bias voltage supplying means for gradually increasing the bias voltage as the developing process proceeds.

5. An image forming method for forming an electrostatic latent image on a photosensitive member by scanning a laser beam on the photosensitive member in a lateral scanning direction with respect to a transferring direction of the photosensitive member to form the electrostatic latent image thereon and by causing the electrostatic latent image to absorb a toner of a liquid developer in a developing dish, wherein a cleaning pattern image having a large toner absorbability for absorbing the toner attached to a surface of the developing dish, is provided on the photosensitive member by scanning the laser beam before the electrostatic latent image is formed on the photosensitive member so that the cleaning pattern image is positioned at a preceding position with respect to the electrostatic latent image in the transferring direction of the photosensitive member, and wherein;

the cleaning pattern image is provided so as to have a larger length than that of the electrostatic latent image provided on the photosensitive member in the lateral scanning direction; and a first effective electric potential defined as an electric potential difference between an electric charge potential of the cleaning pattern image and an electric potential of the developing dish, is made larger in the developing process of the cleaning pattern image than a second effective electric potential defined as an electric potential difference between an electric charge potential of the electrostatic latent image and another electric potential of the developing dish in the developing process of the electrostatic latent image.

6. An image forming method for forming an electrostatic latent image on a photosensitive member by scanning a laser beam on the photosensitive member in a lateral scanning direction with respect to a transferring direction of the photosensitive member to form the electrostatic latent image thereon and by causing the electrostatic latent image to absorb a toner of a liquid developer in a developing dish, wherein a cleaning pattern image having a large toner absorbability for absorbing the toner attached to a surface of the developing dish, is provided on the photosensitive member by scanning the laser beam after the electrostatic latent image is formed on the photosensitive member so that the cleaning pattern image is positioned succeeding to the electrostatic latent image with respect to the transferring direction of the photosensitive member, and wherein the cleaning pattern image is provided so as to have a larger length than that of the electrostatic latent image provided on the photosensitive member in the lateral scanning direction; and a first effective electric potential defined as an electric potential difference between an electric charge potential of the cleaning pattern image and an electric potential of the developing dish, is made larger in the developing process of the cleaning pattern image than a second effective electric potential defined as another electric potential difference between an electric charge potential of the electrostatic latent image and another electric potential of the developing dish in the developing process of the electrostatic latent image.

7. An image forming apparatus for forming an electrostatic latent image on a photosensitive member, the photosensitive member being preliminarily charged electrically and the electrostatic latent image being formed thereon by scanning a laser beam on the photosensitive member in a lateral scanning direction perpendicular to a transferring direction of the photosensitive member, thereby the photosensitive member being exposed to the laser beam to form the electrostatic latent image thereon and the electrostatic latent image thus formed being developed by causing the electrostatic latent image thus formed to absorb a toner of a liquid developer in a developing dish, the image forming apparatus comprising:

memory means for storing data of a cleaning pattern image having a larger toner absorbability for absorbing the toner attached to a surface of the developing dish;

control means for controlling the data of the cleaning pattern image so as to be formed on the photosensitive member before the electrostatic latent image is formed on the photosensitive member so that the cleaning pattern image is positioned preceding to a front side of the electrostatic latent image with respect to the transferring direction of the photosensitive member, and wherein the control means controls a first effective electric potential defined as an electric potential difference between an electric charge potential of the cleaning pattern image and an electric potential of the developing dish, so as to be larger than a second effective electric potential defined as another electric potential difference between an electric charge potential of the electrostatic latent image and another electric potential of the developing dish.

8. An image forming apparatus for forming an electrostatic latent image on a photosensitive member, the photosensitive member being preliminarily charged electrically and the electrostatic latent image being formed thereon by scanning a laser beam on the photosensitive member in a lateral scanning direction perpendicular to a transferring direction of the photosensitive member, thereby the photosensitive member being exposed to the laser beam to form the electrostatic latent image thereon and the electrostatic latent image thus formed being developed by causing the electrostatic latent image to absorb a toner of a liquid developer in a developing dish, the image forming apparatus comprising:

memory means for storing data of a cleaning pattern image having a large toner absorbability for absorbing the toner attached to a surface of the developing dish;

control means for controlling the data of the cleaning pattern image so as to be formed on the photosensitive member after the electrostatic latent image is formed on the photosensitive member so that the cleaning pattern image is positioned succeeding to the electrostatic latent image with respect to the transferring direction of the photosensitive member; and wherein;

the control means controls a first effective electric potential defined as an electric potential difference between an electric charge potential of the cleaning pattern image and an electric potential of the developing dish, so as to be larger than a second effective electric potential defined as an electric potential difference between an electric charge potential of the electrostatic latent image and another electric potential of the developing dish.

* * * * *